US007575347B1

(12) United States Patent
Daly

(10) Patent No.: US 7,575,347 B1
(45) Date of Patent: Aug. 18, 2009

(54) MAGNETIC LIGHT

(76) Inventor: John Daly, 32111 Dewberry La., Sorrento, FL (US) 32776

( * ) Notice: Subject to any disclaimer, the term of this patent is extended or adjusted under 35 U.S.C. 154(b) by 0 days.

(21) Appl. No.: 12/283,160

(22) Filed: Sep. 11, 2008

(51) Int. Cl.
*F21V 21/096* (2006.01)

(52) U.S. Cl. ..... 362/398; 362/191; 362/200

(58) Field of Classification Search ..... 362/398, 362/191, 190, 200, 184
See application file for complete search history.

(56) References Cited

U.S. PATENT DOCUMENTS 6,877,880 B2 * 4/2005 Endo ..... 362/282
6,923,550 B2 * 8/2005 Lee ..... 362/191
2004/0017681 A1 * 1/2004 Lee ..... 361/133
2004/0037071 A1 * 2/2004 Lee ..... 362/190
2005/0047124 A1 * 3/2005 Hsien ..... 362/188

* cited by examiner

*Primary Examiner*—Laura Tso
(74) *Attorney, Agent, or Firm*—Charles M. Kaplan

(57) ABSTRACT

An auxiliary light source has battery operated LEDs and uses embedded magnets to attach the light source to another object. The light beams from the LEDs shine along axes that are parallel to the central axes of the magnets. This makes the auxiliary light especially adapted for magnetic attachment to an inspection mirror because the projected light beams will shine on objects the user of the mirror intends to have illuminated.

20 Claims, 5 Drawing Sheets

MAGNETIC LIGHT

BACKGROUND OF THE INVENTION

This invention relates to light sources that use magnets to hold them in place. Prior magnetic lights often were bulky and difficult to use in cramped spaces by technicians, such as HVAC servicemen needing to read serial numbers or other information on the outside of unmovable machines. Many prior magnetic light sources were single or limited purpose lights designed to be attachable to only a small number of objects of preselected shapes or contours.

OBJECTIVES OF THE INVENTION

Accordingly, it is an object of this invention to provide improved magnetic light sources.

Another object is to provide light emitting diode (LED) light sources that are attachable to metal surfaces.

An additional object is to provide a compact magnetic light that can be used in the tight spaces between immovable objects.

Another object is to provide a magnetic light and inspection mirror that are usable as a unit to examine different types of machines and objects.

Another object is to provide a LED light source that can be magnetically attached to differently shaped tools and other objects.

A further object is to provide a magnetic LED light source that can shine its beam along an axis that is essentially perpendicular to a surface to which its magnet is attracted.

Another object is to provide an auxiliary light that is especially suited to being magnetically attached to an inspection mirror.

A further object is to provide the combination of an inspection mirror and a magnetically attached LED light source that are usable in cramped spaces.

A further object is to provide magnetic lights that are compact, durable, economical, easy to use and adjust, and which do not possess defects found in similar prior art light sources.

Other objects and advantages of the magnetic lights and the inspection mirrors combinations in accord with this invention will be found in the specification and claims and the scope of the invention will be set forth in the claims.

DESCRIPTION OF THE INVENTION

Figure 1:
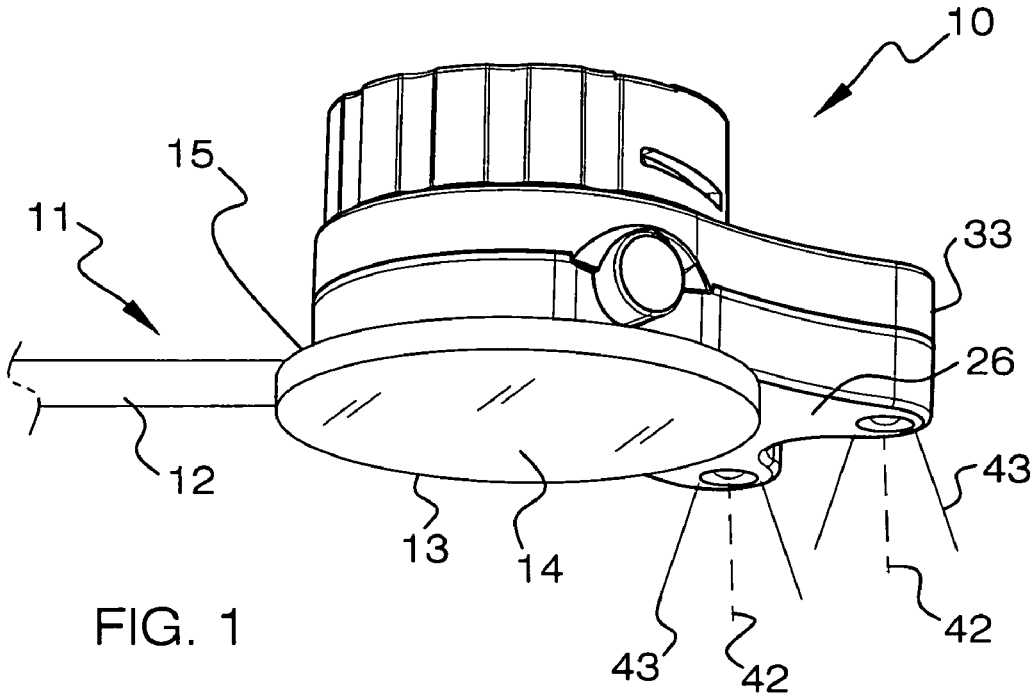
FIG. 1 is a perspective view of an embodiment of an inspection mirror and magnetic light in accord with this invention.
Figure 2:
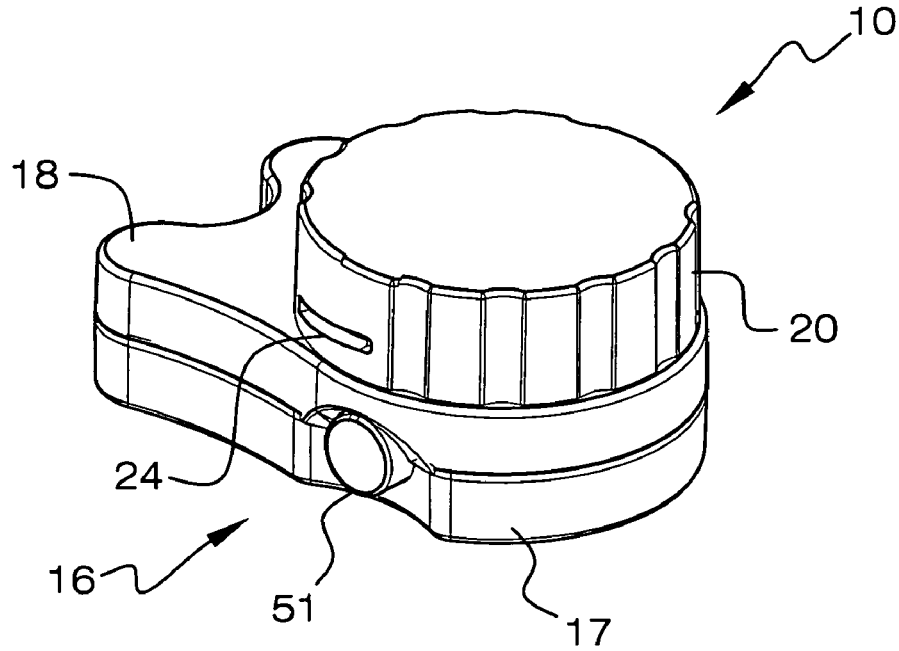
FIG. 2 is perspective view showing top surfaces of the magnetic light in FIG. 1.
Figure 3:
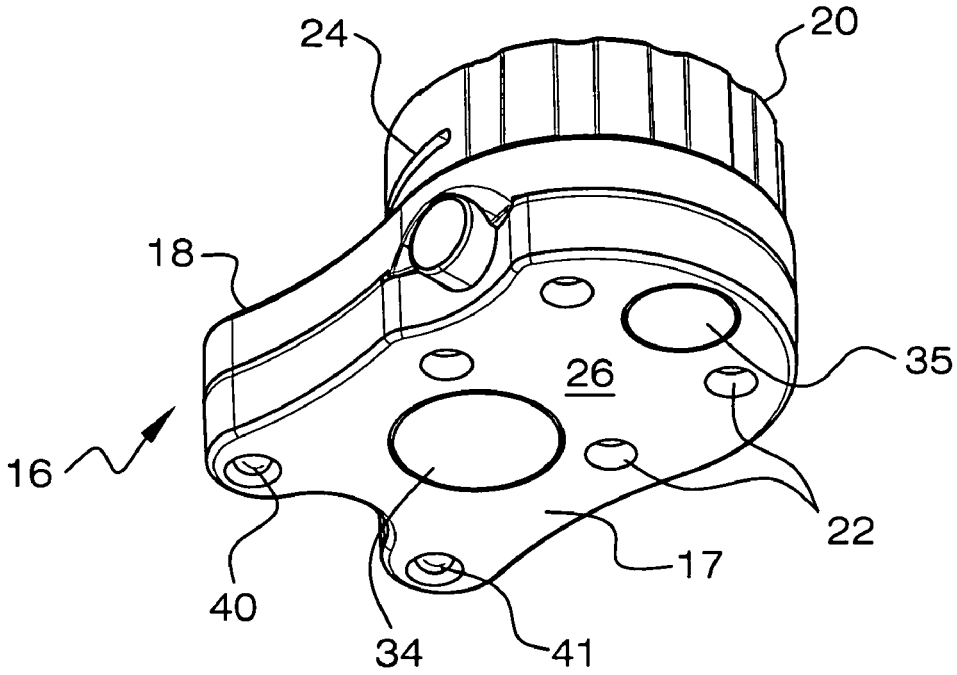
FIG. 3 is perspective view showing bottom surfaces of the magnetic light in FIG. 1.
Figure 4:
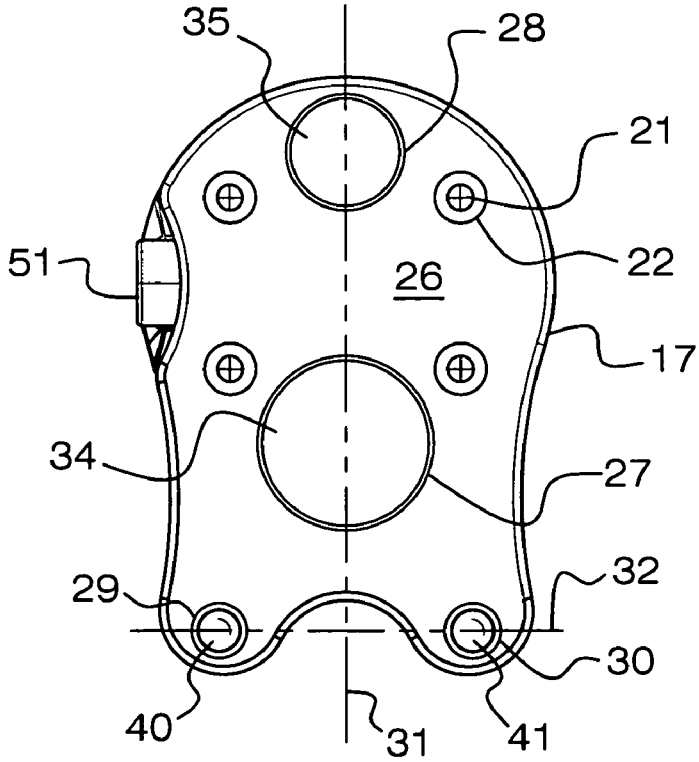
FIG. 4 is an enlarged bottom plan view of the magnetic light in FIG. 1.
Figure 5:
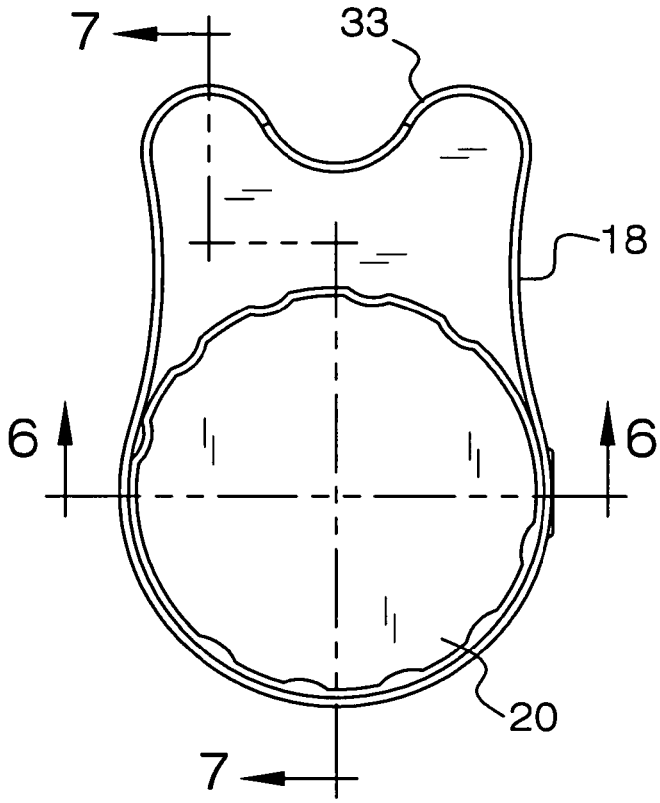
FIG. 5 is an enlarged top plan view of the magnetic light in FIG. 1.
Figure 6:
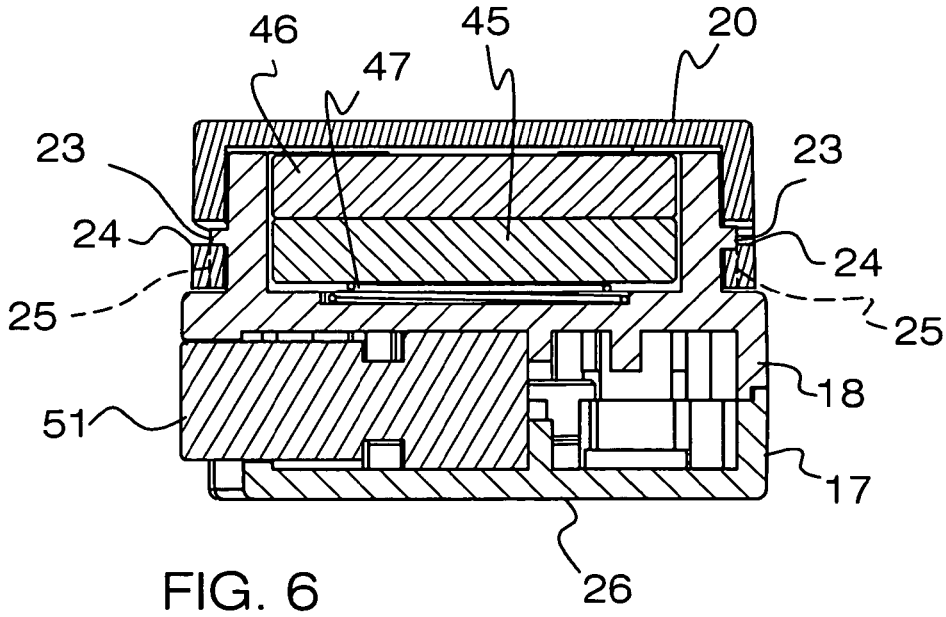
FIG. 6 a cross sectional view taken along the line 6-6 in FIG. 5.
Figure 7:
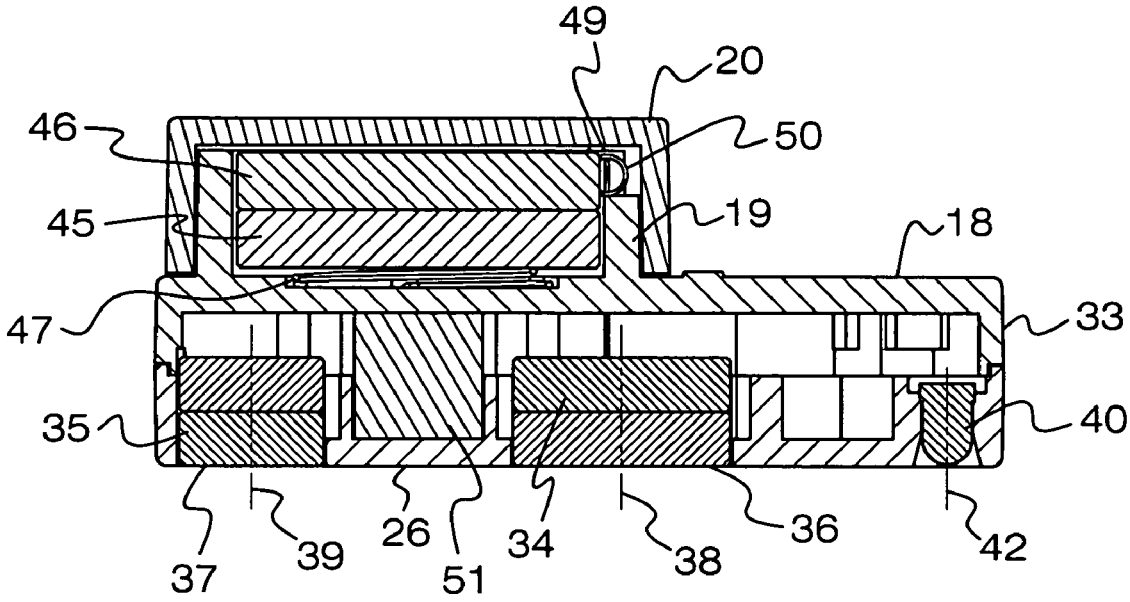
FIG. 7 is a cross sectional view taken along the line 7-7 in FIG. 5.
Figure 9:
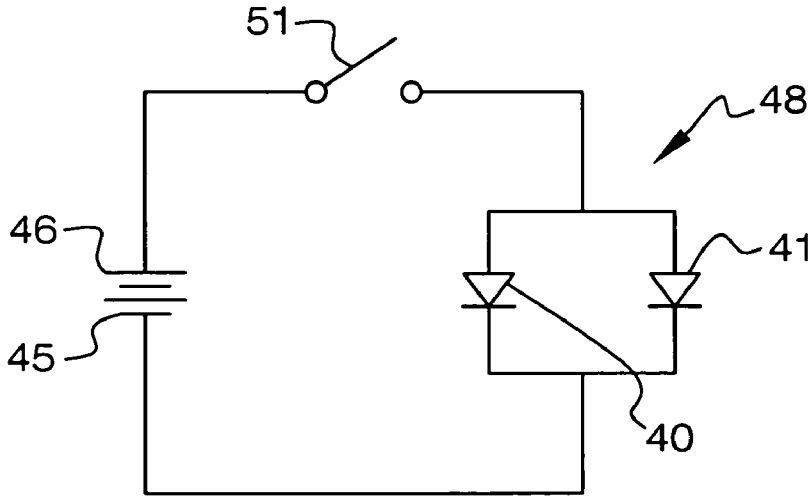
FIG. 9 is a circuit diagram of the magnetic light in FIG. 1.
Figure 8:
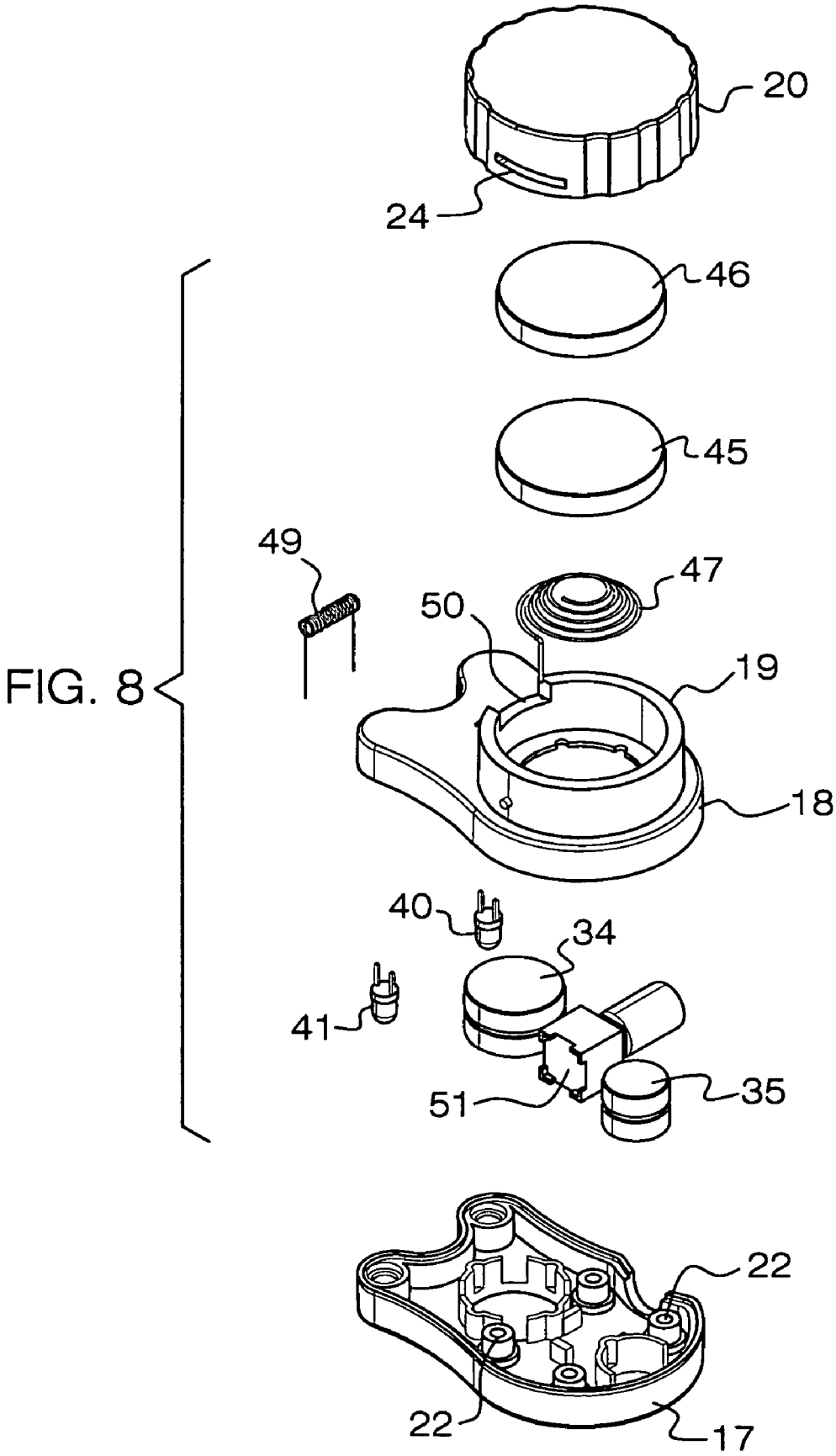
FIG. 8 is an exploded perspective view showing the major components of the magnetic light in FIG. 1.

The drawing shows auxiliary light 10, in accord with this invention, magnetically attached to a conventional inspection device 11 having a handle 12 connected to a mirror 13 with a first surface 14 for reflecting an image of an object being inspected and a second opposite surface 15 that may be metal, or otherwise may be made magnetically attractable as by attaching a metal strip thereto.

The parts of light 10 are contained in a plastic housing 16 having a lower body portion 17, an upper body portion 18 having an integral battery receptacle 19 that is closed by a removable cap 20. Body portions 17 and 18 are held together by screws 21 in holes 22. Cap 20 may be held on body portion 18 by a pair of diametrically opposed nibs 23 that engage slots 24 through opposed surfaces of the cap, with the cap being removable when it is pushed down and rotated so as to align the nibs 23 with perpendicular release slots 25 in the inside surface of the cap.

Lower body portion 17 has a flat outer surface 26 perforated by a first pair of circular holes 27 and 28 having their diameters aligned along a first axis 31 of diametrical alignment, and a second pair of circular holes 29 and 30 having their diameters aligned along a second axis 32 of diametrical alignment at an end 33. The respective axes 31 and 32 of diametrical alignment are perpendicular to each other. Magnets 34 and 35 are imbedded in and visible through the first pair of holes 27 and 28. Magnets 34 and 35 may each comprise a pair of identical, axially-aligned cylindrical magnets as illustrated, or magnets 34 and 35 may each be only a single magnet. The magnets 34 and 35 have flat outer surfaces 36 and 37 that are flush, or in the same plane, with surface 26, and the central axes 38 and 39 of the magnets are parallel to each other and perpendicular to the surface 26. Magnet 34 is larger than magnet 35 and its surface, exposed through hole 27, may be about three times the area of magnet 35 exposed through hole 28, making magnet 34 stronger than magnet 35. Magnets 34 and 35 are high strength with pull forces of several pounds, and the magnets may be rare earth or ceramic.

A pair of LED lights 40 and 41 are aligned with the second pair of holes 29 and 30 at one end. LED lights 40 and 41 emit their beams 43 through holes 29 and 30 along parallel axes 42 that are also parallel to the central axes 38 and 39 of the magnets 34 and 35. The LEDs may be 3 mm High Brightness White lights operable on a voltage of 5 to 6 volts.

A pair of identical batteries 45 and 46 are housed in a receptacle 19. A compression spring 47 in receptacle 19 contacts the negative surface of battery 45 and urges the positive surface of battery 45 into contact with the negative surface of battery 46. Spring 47 is the anode terminal in the electric circuit 48 of auxiliary light 10. A coil spring 49 is located in a slot 50 in the outer edge of receptacle 10. Spring 49 contacts the positive surface of battery 46 at the battery outer edge, and the spring 49 is the cathode terminal of circuit 48. Cap 20 pushes batteries 45 and 46 against compressing spring 47, and cap 20 hold battery 46 in a position in which the outer edge of battery 46 pushes against and deforms spring 49 into the slot 50. A push button switch 51 in circuit 48 is operable from the outside of auxiliary light 10 to turn the LED lights off and on. Batteries 45 and 46 may be CR 2032 computer batteries providing 3 volts each configured in series for a 6.0 volt bias to the LEDs.

The use of two differently sized rare earth magnets 34 and 35 that are separated from each other along axis 32 permits attachment of the light 10 to a wide variety of differently sized and differently shaped objects. This versatility is enhanced by locating the larger magnet 34 closer to end 33 and the axis 32 of alignment of the LED lights 40 and 41. The compact size of magnetic light 10 (approximately 4×3×2 cm) enables the LED lights 40 and 41 to bring strong light beams into cramped spaces between unmovable objects and other difficult to reach spaces.

The beams 43 of light emitted by LED lights 40 and 41 project along axes 42 that are parallel to the central axes 38 and 39 of magnets 34 and 35. This causes the light beams 43 to project at essentially right angles to the surface, such as 15, of an object to which the light 10 has been magnetically attached. As shown in FIG. 1, a portion of the surface 26 of housing 16 and the LED lights 40 and 41 at end 33 extend beyond inspection mirror 11 so the light beams shine along axes 42 at angles essentially perpendicular to the back 15 of mirror 13. This enables the light 10 to illuminate objects that the mirror 13 is intended to show to its user.

While the present invention has been described with reference to particular embodiments, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

I claim:

1. An auxiliary light for attachment to another object, said light comprising: a housing having a flat outer surface with a hole therethrough;

a magnet imbedded in said outer surface of said housing, said magnet having a flat surface in the same plane as said outer surface of said housing, said magnet having a central axis that is perpendicular to said outer surface of said housing;

a LED light in said housing, said LED light being aligned with said hole through said outer surface of said housing, said LED light emitting its beam through said hole along an axis that is parallel to said central axis of said magnet;

a battery enclosed in said housing, and electric circuitry connecting said battery to said LED light through a switch which is operable from the outside of said housing.

2. The auxiliary light defined in claim 1, further comprising: said magnet comprising a pair of magnets spaced from each other in said outer surface of said housing.

3. The auxiliary light defined in claim 2, further comprising: one magnet of said pair of magnets being larger than the other magnet.

4. The auxiliary light defined in claim 3, further comprising: the larger of said pair of magnets being located closer to said LED light than said other magnet.

5. The auxiliary light defined in claim 1, further comprising: said LED light comprising a pair of LED lights separated from each other on opposite sides of said magnet.

6. The auxiliary light defined in claim 1, further comprising: said magnet comprising a pair of magnets spaced from each other in said outer surface of said housing, one magnet of said pair of magnets being larger than the other magnet, said LED light comprising a pair of LED lights separated from each other on opposite sides of said pair of magnets, and the larger of said pair of magnets being located closer to said LED lights than said other magnet.

7. The auxiliary light defined in claim 6, further comprising: said pair of magnets being spaced from each other along a first axis of diametrical alignment, said pair of LED light being spaced from each other along a second axis of diametrical alignment, and the first and second axes of diametrical alignment being perpendicular to each other.

8. An auxiliary light for attachment to another object, said light comprising: a housing having a flat outer surface having therethrough a first pair of holes that are spaced from each other along an a first axis of diametrical alignment and a second pair of holes that are spaced from each other along a second axis of diametrical alignment;

a pair of separated magnets imbedded in and visible through the first of said pairs of holes in said outer surface of said housing, each of said magnets having a central axis that is perpendicular to said outer surface of said housing;

a pair of LED lights in said housing, said LED lights each being aligned with a hole of the second pair holes through said outer surface of said housing, said LED lights emitting their beams through said second pair of holes along axes that are parallel to the central axis of each of said magnets;

a battery enclosed in said housing, and electric circuitry connecting said battery to said LED lights through a switch which is operable from the outside of said housing.

9. The auxiliary light defined in claim 8, further comprising: one magnet of said pair of magnets being larger than the other magnet.

10. The auxiliary light defined in claim 9, further comprising: the larger of said pair of magnets being located closer to said pair of LED lights than said other magnet.

11. The auxiliary light defined in claim 9, further comprising: each said LED lights being separated from each other on opposite sides of said pair of magnets.

12. The auxiliary light defined in claim 9, further comprising: the first and second axes of diametrical alignment being perpendicular to each other.

13. The combination comprising an inspection device and a selectively attachable and removable light for illuminating an object being inspected:

A. said inspection device comprising: a handle, a mirror connected to said handle having a first surface for reflecting an image of the object being inspected, and a second opposite magnetically attractive surface;

B. said selectively attachable and removable light comprising: a housing having a flat outer surface with a hole therethrough at one of its ends;

a magnet imbedded in said outer surface of said housing, said magnet having a central axis that is perpendicular to said outer surface of said housing, said magnet attaching said light to said outer surface of said housing to said second surface of said inspection device;

a LED light in said housing, said LED light being aligned with said hole through said outer surface of said housing, said hole and a portion of said outer surface of said housing at said one end extending beyond said inspection device, said LED light emitting its beam through said hole along an axis that is parallel to said central axis of said magnet so as to illuminate the object being inspected;

a battery enclosed in said housing, and electric circuitry in said housing connecting said battery to said LED light through a switch which is operable from the outside of said housing.

14. The combination defined in claim 13, further comprising: said magnet comprising a pair of magnets spaced from each other in said outer surface of said housing.

15. The combination defined in claim 14, further comprising: one magnet of said pair of magnets being larger than the other magnet.

16. The combination defined in claim 15, further comprising: the larger of said pair of magnets being located closer to said LED light than said other magnet.

17. The combination defined in claim 13, further comprising: said LED light comprising a pair of LED lights separated from each other on opposite sides of said magnet.

18. The combination defined in claim 13, further comprising: said magnet comprising a pair of magnets spaced from each other in said outer surface of said housing, one magnet of said pair of magnets being larger than the other magnet, said LED light comprising a pair of LED lights separated from each other on opposite sides of said pair of magnets, and the larger of said pair of magnets being located closer to said LED lights than said other magnet.

19. The auxiliary light defined in claim 18, further comprising: said pair of magnets being spaced from each other along a first axis of diametrical alignment, and said pair of LED light are spaced from each other along a second axis of diametrical alignment.

20. The auxiliary light defined in claim 19, further comprising: the first and second axes of diametrical alignment being perpendicular to each other.

* * * * *